US009427783B2

(12) United States Patent
Nakano

(10) Patent No.: US 9,427,783 B2
(45) **Date of Patent: *Aug. 30, 2016**

(54) POSTAL MATTER EJECTION APPARATUS WITH GAP SETTING UNIT ACCORDING TO POSTAL MATTER THICKNESS

(71) Applicant: KABUSHIKI KAISHA TOSHIBA, Tokyo (JP)

(72) Inventor: Toshiki Nakano, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/734,266

(22) Filed: Jun. 9, 2015

(65) Prior Publication Data

US 2015/0266061 A1 Sep. 24, 2015

Related U.S. Application Data

(60) Continuation of application No. 14/178,489, filed on Feb. 12, 2014, now abandoned, which is a division of application No. 13/778,375, filed on Feb. 27, 2013, now Pat. No. 9,022,385.

(30) Foreign Application Priority Data

Feb. 28, 2012 (JP) ..... 2012-042104

(51) Int. Cl.
*B65H 43/04* (2006.01)
*B07C 1/04* (2006.01)
(Continued)

(52) U.S. Cl.
CPC . *B07C 1/04* (2013.01); *B65H 3/06* (2013.01); *B65H 3/0653* (2013.01); *B65H 7/02* (2013.01);
(Continued)

(58) Field of Classification Search
CPC ..... B65H 7/02; B65H 7/20; B65H 2511/13; B65H 2511/22; B65H 2553/40; B65H 2513/50
USPC ..... 271/265.04, 10.02, 110
See application file for complete search history.

(56) References Cited

U.S. PATENT DOCUMENTS 4,787,620 A 11/1988 Goldkuhle
5,458,324 A 10/1995 Nakamura et al.
(Continued)

FOREIGN PATENT DOCUMENTS

EP 0227998 A1 7/1987
EP 1683586 A1 7/2006
(Continued)

OTHER PUBLICATIONS

European Search Report mailed Jul. 13, 2015 in the corresponding EP application No. 13157168.9.
(Continued)

*Primary Examiner* — David H Bollinger
(74) *Attorney, Agent, or Firm* — Posz Law Group, PLC

(57) ABSTRACT

A postal matter ejection apparatus includes an ejection unit, a thickness detection unit, a thickness storage unit, a detection unit, an acquisition unit, a setting unit, and an adjustment unit. The ejection unit ejects a postal matter. The thickness detection unit measures a thickness of the postal matter. The thickness storage unit stores thickness information. The acquisition unit acquires a thickness of a preceding postal matter. The setting unit sets a gap between the preceding postal matter and the postal matter ejected by the ejection unit in accordance with the thickness of the preceding postal matter. The adjustment unit adjusts timing for supplying the postal matter to a conveyance path in accordance with the gap.

5 Claims, 6 Drawing Sheets

(51) Int. Cl.

| | |
|---|---|
| ***B65H 3/06*** | (2006.01) |
| ***B65H 7/02*** | (2006.01) |
| ***B65H 7/20*** | (2006.01) |
| ***B65H 7/06*** | (2006.01) |
| ***B65H 29/62*** | (2006.01) |
| ***B65H 7/14*** | (2006.01) |
| ***B65H 29/58*** | (2006.01) |
| ***B65H 29/60*** | (2006.01) |

(52) U.S. Cl.
CPC *B65H 7/06* (2013.01); *B65H 7/14* (2013.01); *B65H 7/20* (2013.01); *B65H 29/58* (2013.01); *B65H 29/60* (2013.01); *B65H 29/62* (2013.01); *B65H 43/04* (2013.01); *B65H 2301/44522* (2013.01); *B65H 2511/13* (2013.01); *B65H 2511/22* (2013.01); *B65H 2513/50* (2013.01); *B65H 2701/1916* (2013.01)

(56) References Cited

U.S. PATENT DOCUMENTS

| | | | | |
|---|---|---|---|---|
| 6,053,495 | A | 4/2000 | Hara et al. | |
| 7,413,185 | B2 | 8/2008 | Mitsuya et al. | |
| 7,912,384 | B2 | 3/2011 | Dan | |
| 8,342,512 | B2 | 1/2013 | Watanabe et al. | |
| 9,022,385 | B2 * | 5/2015 | Nakano | B65H 3/06 271/10.02 |
| 2011/0074088 | A1 | 3/2011 | Watanabe et al. | |
| 2013/0026699 | A1 | 1/2013 | Maruta et al. | |

FOREIGN PATENT DOCUMENTS

| | | | |
|---|---|---|---|
| EP | 2495194 | A2 | 9/2012 |
| JP | 2000-189904 | A | 7/2000 |
| JP | 2001-278534 | A | 10/2001 |
| JP | 2011-046539 | A | 11/2010 |

OTHER PUBLICATIONS

Office Action mailed Jul. 28, 2015 issued in corresponding JP patent application No. 2012-042104 (and English translation).

* cited by examiner

POSTAL MATTER EJECTION APPARATUS WITH GAP SETTING UNIT ACCORDING TO POSTAL MATTER THICKNESS

CROSS-REFERENCE TO RELATED APPLICATIONS

This application is a continuation of U.S. patent application Ser. No. 14/178,489 filed Feb. 12, 2014, which is a divisional of U.S. patent application Ser. No. 13/778,375 filed Feb. 27, 2013, and is based upon and claims the benefit of priority from Japanese Patent Application No. 2012-042104, filed Feb. 28, 2012, the entire contents of all of which are incorporated herein by reference.

FIELD

Embodiments described herein relate generally to a sheet ejection apparatus and a sheet processing apparatus.

BACKGROUND

For example, a sheet processing apparatus such as a mail sorting apparatus comprises a sheet ejection apparatus configured to eject sheets such as postal matters which are processing targets. Much of the sheet processing apparatuses process the sheets ejected by the sheet ejection apparatus while conveying them. However, the sheets having different thicknesses cannot be often conveyed at the same speed, even if a conveying mechanism operates at a constant speed. For example, when the thicknesses of the sheets increase, a conveying speed tends to be slow. If the conveying speed of each sheet is not constant, gaps between preceding and following sheets conveyed in the sheet processing apparatus vary. When the following sheet catches up the preceding sheet, the sheet processing apparatus cannot normally process the sheets, and hence the apparatus discharges both the following sheet and the preceding sheet.

DETAILED DESCRIPTION

Figure 1A:
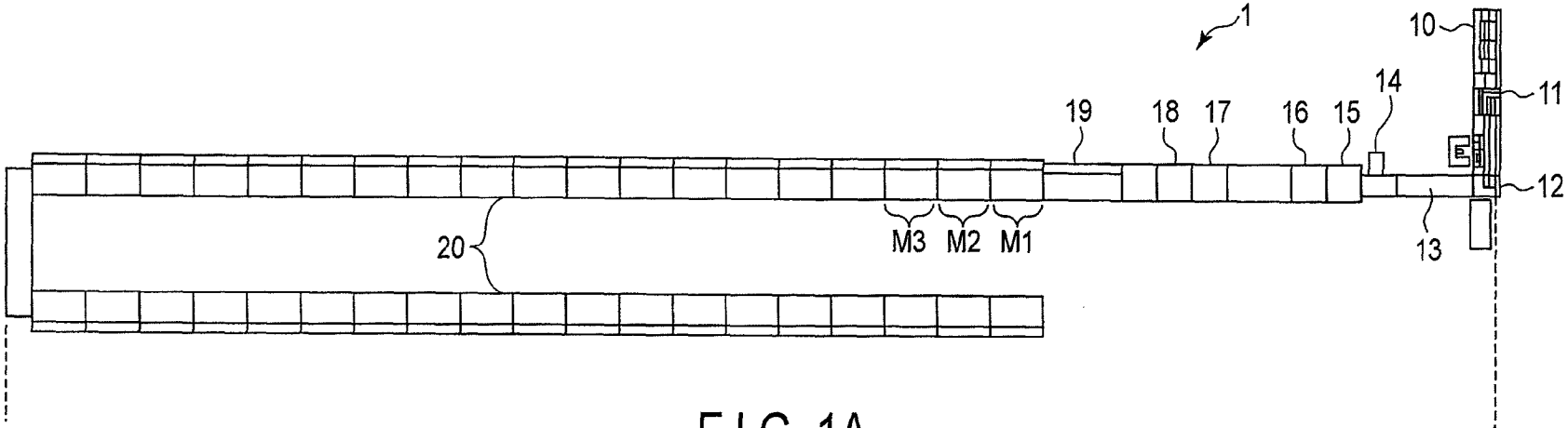
FIG. 1A is an overall view of a sheet processing apparatus including a sheet ejection apparatus according to an embodiment.

In general, according to one embodiment, a sheet ejection apparatus includes an ejection unit, a thickness detection unit, a thickness storage unit, a sheet detection unit, an acquisition unit, a setting unit, and an adjustment unit. The ejection unit ejects a sheet that is to be conveyed to a conveyance path. The thickness detection unit measures a thickness of the sheet ejected by the ejection unit. The thickness storage unit stores thickness information detected by the thickness detection unit. The sheet detection unit detects the sheet ejected by the ejection unit. The acquisition unit acquires from the thickness storage unit a thickness of a preceding sheet conveyed to the conveyance path prior to the sheet ejected by the ejection unit. The setting unit sets a gap between the preceding sheet and the sheet ejected by the ejection unit in accordance with the thickness of the preceding sheet acquired by the acquisition unit. The adjustment unit adjusts timing for supplying the sheet detected by the sheet detection unit to the conveyance path in accordance with the gap set by the setting unit.

An embodiment will be described hereinafter with reference to the drawings.

A sheet processing apparatus according to this embodiment is configured to process respective sheets wile sequentially conveying the sheets. For example, as the sheet processing apparatus, assumed is a mail sorting device or the like that sorts postal matters (postcards, sealed matters, and others) as sheets in accordance with destination information (sorting information), e.g., an address or a postal code and accumulates the sorted sheets. Further, the sheet processing apparatus according to this embodiment comprises an ejection unit as a sheet ejection apparatus that ejects a sheet as a processing target from a supply unit and conveys it to a conveyance path in the sheet processing apparatus. For example, the sheet ejection apparatus according to this embodiment can be used as an ejection unit that ejects a postal matter which is a processing target in the mail sorting device.

Furthermore, the mail sorting device as an example of the sheet processing apparatus carries out the following processing as processing for postal matters as sheets. The mail sorting device ejects postal matters one by one and sequentially conveys the postal matters. The mail sorting device reads an image on each postal matter to be conveyed by using a scanner and recognizes destination information such as an address and a postal code from the read image of each sheet. The mail sorting device associates stackers provided in an accumulation unit with various kinds of destination information (sorting information for delivery) in advance and decides a stacker as a sorting destination of each postal matter based on recognition result of the destination information for the read image of each postal matter. The mail sorting device conveys each sheet to the stacker decided as the sorting destination and accumulates it.

Figure 1B:
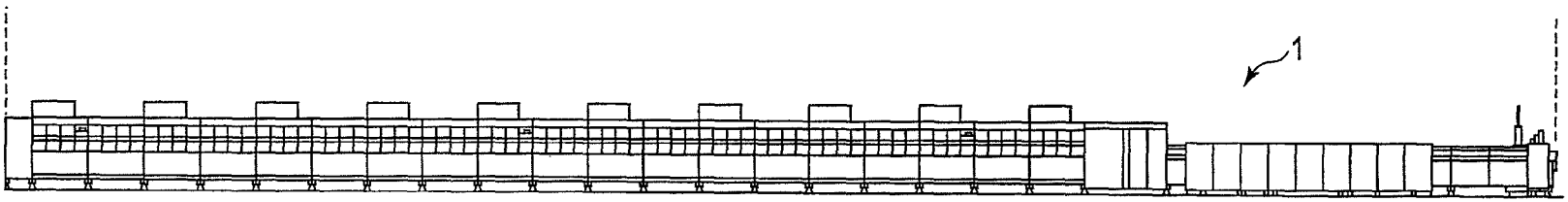
FIG. 1B is an overall view of the sheet processing apparatus including the sheet ejection apparatus according to the embodiment.

Each of FIG. 1A and FIG. 1B shows a structural example of a sheet processing apparatus 1 according to an embodiment. FIG. 1A shows a structural example of various modules in the sheet processing apparatus 1. FIG. 1B shows a structural example of appearance when the sheet processing apparatus 1 depicted in FIG. 1A is shown from its side surface. As the sheet processing apparatus 1 shown in FIG. 1A and FIG. 1B, assumed is a mail sorting device that sorts each postal matter (e.g., a letter or a sealed matter) as a sheet based on sorting information as destination information, e.g., an address and postal code.

In the structural example shown in FIG. 1A, the sheet processing apparatus 1 comprises processing modules such as an operation panel 10, a supply unit 11, an ejection unit 12, a conveyance unit (conveyance path) 13, a discharge unit 14, a pre-barcode read unit 15, a character recognition unit 16, a print unit 17, a verify barcode read unit 18, a branch unit, and an accumulation unit 20. Additionally, the sheet processing apparatus 1 has a control system comprising control units that control operations of the respective modules and a control unit that integrally controls the control units of the respective modules. It is to be noted that a structural example of the control system will be described later.

The operation panel 10 functions as a user interface. The operation panel 10 has, e.g., an operation unit and a display unit. The operation panel 10 is constituted of, e.g., a display device having a built-in touch panel as the operation unit. Further, the operation panel 10 may be constituted of a keyboard as the operation unit and a display device as the display unit.

The operation panel 10 as the operation unit accepts input of various operations performed by an operator. The operation panel 10 transmits a signal indicative of input operation contents to the control unit. The operation panel 10 as the display unit displays a screen generated by the control unit. For example, the operation panel 10 displays various kinds of operation guidance, processing results, and others to the operator.

The supply unit 11 stocks the sheets as processing targets. The supply unit 11 is set while having the sheets as sorting processing targets overlapping therein. As each sheet that is a sorting processing target, assumed is a sheet having a character string indicative of a sorting destination written on a first surface thereof. For example, the character string representing a sorting destination may be a character string representing a destination such as an address or a postal code. For example, the sheets are set in the supply unit 11 with their trailing ends being trued up in such a manner that the first surfaces face the same direction. The supply unit 11 sequentially supplies the sheets to the ejection unit 12 installed at an ejecting position.

The ejection unit 12 ejects the sheets set in the supply unit 11 one by one at predetermined gaps. The ejection unit 12 functions as a sheet ejection apparatus that ejects postal matters as the sheets which are processing targets. The ejection unit 12 supplies the sheets ejected from the supply unit 11 to a conveyance path of the conveyance unit 13. The ejection unit 12 has a later-described ejection roller, a delivery roller, various sensors, and others. For example, when the ejection roller installed in contact with a sheet placed at an end portion (the ejecting position) of the supply unit 11 rotates, the ejection unit 12 ejects the sheets set in the supply unit 11 one by one from the end portion of the supply unit 11. The ejection unit 12 delivers the sheets ejected by the ejection roller to the conveyance unit 13 by using the delivery roller. A structural example of the ejection unit 12 will be described later in detail.

The conveyance unit 13 has a conveyance path along which the sheets are conveyed to the respective units in the sheet processing apparatus 1. The conveyance path as the conveyance unit 13 is constituted of conveyance mechanisms, e.g., a conveyance roller, a conveyance belt, and a drive pulley. The drive pulley is driven by a drive motor, and the conveyance belt is operated by the drive pulley. The conveyance unit 13 conveys the sheets ejected by the ejection unit 12 by operating the conveyance path constituted of the conveyance mechanism, e.g., the conveyance belt at a constant speed. Furthermore, sensors and gates are set respective positions on the conveyance path in the sheet processing apparatus 1. A control system of the sheet processing apparatus 1 sequentially controls the gates or the like in accordance with a processing result of each module and controls conveyance of the sheets using the conveyance path.

The discharge unit 14 is provided on the conveyance unit 13. The discharge unit 14 detects and discharges each sheet which cannot be subjected to subsequent processing. For example, the discharge unit 14 judges whether the subsequent processing can be performed with respect to each sheet. The discharge unit 14 comprises a non-illustrated discharge and accumulation unit. The discharge and accumulation unit accumulates sheets which have been determined to be inappropriate for the subsequent processing (sheets determined to be discharged).

The discharge unit 14 has a length detection unit, a thickness detection unit, and a hardness detection unit. The length detection unit detects a length of each sheet in a conveyance direction. The discharge unit 14 detects each sheet whose length is outside the scope of specifications (which cannot be processed) by using the length detection unit. The thickness detection unit detects a thickness of each sheet. The discharge unit 14 detects each sheet whose thickness is outside the scope of specifications (which cannot be processed) by using the thickness detection unit. The hardness detection unit detects hardness of each sheet. The discharge unit 14 detects each sheet whose hardness is outside the scope of specifications (which cannot be processed) by using the hardness detection unit. The discharge unit 14 discharges each sheet whose length, thickness, or hardness has been detected as being outside the scope of specification.

Furthermore, the discharge unit 14 has a foreign substance detection unit, a metal detection unit, a state detection unit, and an overlap detection unit. The foreign substance detection unit detects each sheet containing a foreign substance that may possibly cause inconveniences in subsequent processing. The metal detection unit detects each sheet containing a metal that may possibly cause inconveniences in subsequent processing. The state detection unit detects each sheet which has a shape and a conveyance state that may possibly cause inconveniences in subsequent processing. The overlap detection unit detects sheets that are conveyed in overlapping state.

The discharge unit 14 discharges each sheet from which a foreign substance has been detected by the foreign substance detection unit, each sheet from which a metal has been detected by the metal detection unit, each sheet which has been detected to have a non-standard shape by the state detection unit, each sheet which has been detected to be in an abnormal conveyance state by the state detection unit, or each sheet which has been detected to be in an overlapping state by the overlap detection unit.

The pre-barcode read unit 15 reads a barcode previously given to each sheet that is conveyed on the conveyance path. The pre-barcode read unit 15 converts the read barcode into information indicative of a sorting destination. The pre-barcode read unit 15 transmits the information indicative of the sorting destination obtained from the read barcode (sorting information) to the control unit. The control unit determines a conveyance destination of the sheet based on the sorting information received from the pre-barcode read unit. The control unit controls each unit to accumulate the sheet on the determined conveyance destination.

The character recognition unit 16 recognizes characters written on the first surface of the sheet conveyed on the conveyance path. The character recognition unit 16 reads an image on the first surface of the sheet by using a scanner and recognizes characters from the image read by the scanner. The character recognition unit 16 transmits a character recognition result including the sorting information of the sheet to the control unit. The control unit generates the sorting information based on the character recognition result received from the character recognition unit 16 and determines a sorting destination associated with the sorting information.

For example, it is assumed that the sheet is a postal matter having characters representing a destination such as an address or a postal code written on the first surface thereof. In this case, the character recognition unit 16 reads an image on the first surface of the postal matter by using the scanner, the scanned image is subjected to OCR processing, and the destination, e.g., the address and the postal code written on the postal matter is recognized. The character recognition unit 16 transmits a character recognition result, e.g., the address and the postal code to the control unit as destination information. The control unit determines a sorting destination of the postal matter based on the destination information received from the character recognition unit 16.

The print unit 17 prints the sorting information representing the sorting destination on the sheet. The print unit 17 prints a barcode representing the sorting information on the sheet. It is satisfactory for the barcode that is printed on the sheet by the print unit 17 to be readable by the barcode read units 15 and 18. For example, the print unit 17 prints a barcode representing the sorting information on the sheet with an ink that cannot be recognized by human eyes. It is to be noted that the print unit 17 may be configured to print a two-dimensional code as the barcode that is printed on the sheet. The sorting information is converted into the barcode.

The verify barcode read unit 18 reads an image including the barcode that is printed by the print unit 17 from the sheet. The verify barcode read unit 18 converts the image of the read barcode into information. The verify barcode read unit 18 transmits the information acquired from the barcode to the control unit as sorting information. The control unit decides a sorting destination (a stacker in the accumulation unit 20) of the sheet based on the sorting information received from the verify barcode read unit 18.

The branch unit 19 distributes each sheet under control of the control system. The branch unit 19 has gates that distribute sheets. Each gate of the branch unit 19 distributes sheets to any one of step paths (which will be described later) leading to the respective stackers of the later-described accumulation unit 20. That is, the control system of the sheet processing apparatus 1 controls an operation of each gate of the branch unit 19 based on the sorting information of each sheet and thereby sends each sheet to any one of the step paths.

The accumulation unit 20 is constituted of modules M (M1, M2, M3, . . . ). Each module M has the stackers that accumulate sheets. For example, each module M has 16 stackers forming four stages and four columns. The number of the stackers in the entire accumulation unit 20 is the number obtained by adding the number of the stackers of all the modules. The sorting information is associated with each stacker. For example, in a mail sorting device, each destination as the sorting information is assigned to each stacker so that postal matters as sheets are aligned in the delivery order.

The accumulation unit 20 has step paths configured to convey each sheet distributed by the branch unit 19 to each module M. In the accumulation unit 20, the respective modules M are coupled in accordance with each step path. The step path is a conveyance path configured to convey each sheets to the respective stackers arranged in a matrix form in each module.

Further, the accumulation unit 20 comprises gates. Each gage is provided in association with each stacker. Each gate is a mechanism that takes in each sheet conveyed by the step paths in the accumulation unit 20 into each stacker. The control system drives each gate at timing for taking each sheet into each stacker from the step path. Each gate that has been turned on guides the sheet conveyed through each step path into each corresponding stacker. Each sheet led from each step path by the gate is taken into the stacker by a taking roller or the like. Each sheet that has been taken in is accumulated in each stacker in order.

The control system performs control to accumulate each sheet having the determined sorting information into the stacker associated with the sorting information in the accumulation unit 20. The control system distributes each sheet to each step path configured to convey the sheet to each stacker corresponding to the sorting information by each gate in the branch unit 19. The control system operates each gate associated with the stacker corresponding to the sorting information in accordance with conveyance timing for the sheet on the step path in the accumulation unit 20. As a result, the sheet sorted based on the sorting information is accumulated in each stacker in the accumulation unit 20. A configuration of the control system of the sheet processing apparatus 1 will now be described.

Figure 2:
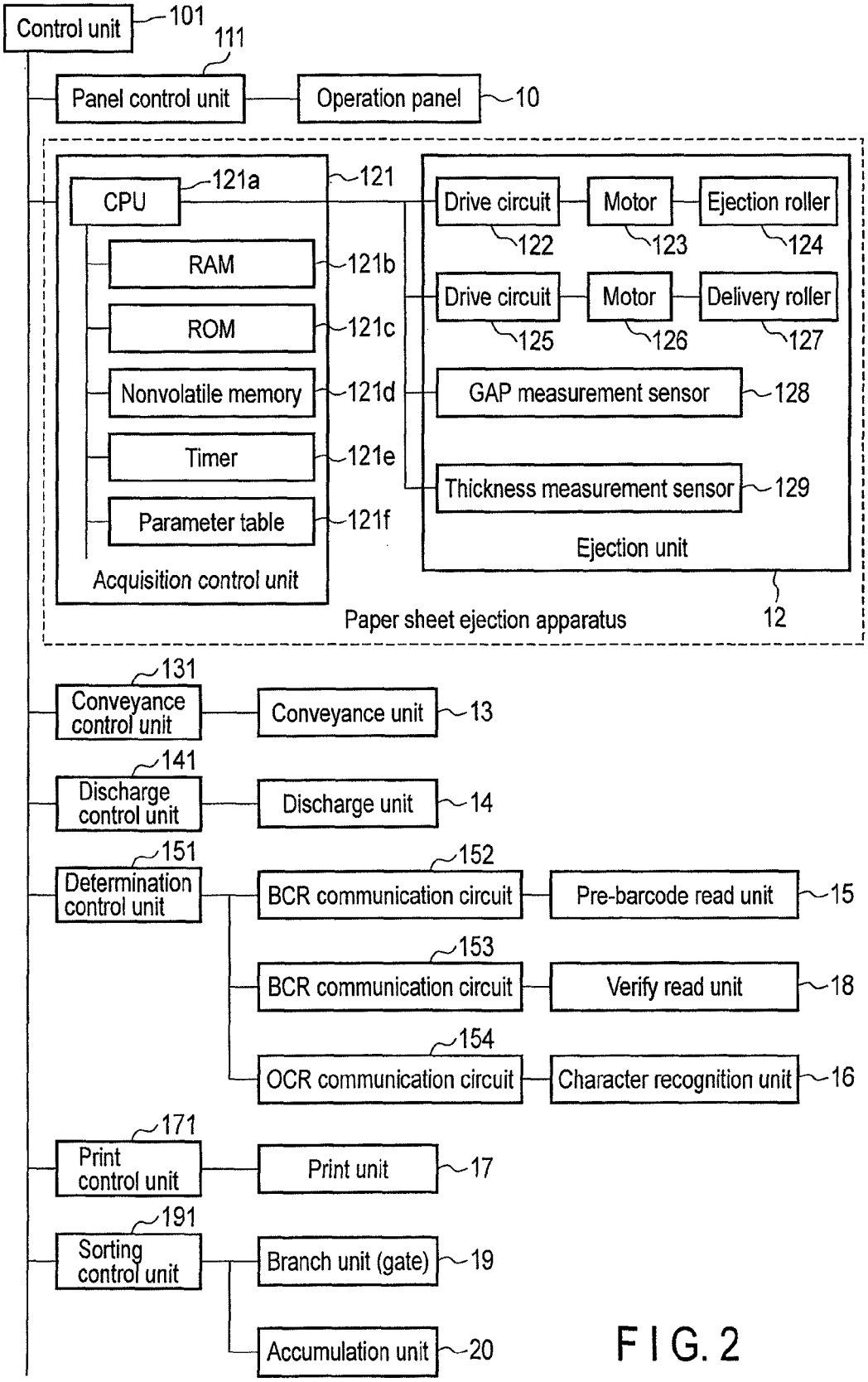
FIG. 2 is a control system diagram of the sheet processing apparatus depicted in FIG. 1A and FIG. 1B.

FIG. 2 is a block diagram showing a structural example of the control system of the sheet apparatus 1.

The sheet processing apparatus 1 comprises a control unit 101, a panel control unit 111, an ejection control unit 121, a conveyance control unit 131, a discharge control unit 141, a determination control unit 151, a print control unit 171, and a sorting control unit 191 as structures in the control system.

The control unit 101 integrally controls operations of the respective units in the sheet processing apparatus 1. The control unit 101 comprises a CPU, a buffer memory, a program memory, a nonvolatile memory, and others. The CPU executes various kinds of arithmetic processing. The buffer memory temporarily stores a result of an arithmetic operation executed by the CPU. The program memory and the nonvolatile memory store various programs executed by the CPU, control data, and others. The control unit 101 can perform various kinds of processing when the CPU executes programs stored in the program memory.

The panel control unit 111 controls the operation panel 10 that displays a processing status of each sheet or abnormality information of the device. It is to be noted that the operation panel 10 is constituted of, e.g., a display device having a built-in touch panel that can display information and allow input of operations.

The ejection control unit 121 controls conveyance of each sheet in and around the ejection unit 12. The ejection control unit 121 controls operations such as ejection of sheets from the supply unit 11 and delivery of the ejected sheets to the conveyance path. For example, the ejection control unit 121 comprises a CPU 121*a*, an RAM 121*b*, an ROM (a program memory) 121*c*, a nonvolatile memory 121*d*, a timer 121*e*, a parameter table 121*f*, and others.

The CPU 121*a* executes various kinds of arithmetic processing. The RAM 121*b* temporarily stores a result of each arithmetic operation executed by the CPU 121*a*. For example, a detection result obtained by the sensor that detects a state of each ejected sheet is stored in the RAM 121*b*. The ROM 121*c* and the nonvolatile memory 121*d* store various programs executed by the CPU 121*a*, control data, and others. The ROM 121*c* is constituted of, e.g., a non-rewritable nonvolatile memory, and the nonvolatile memory 121*d* is constituted of a writable nonvolatile memory. The ejection control unit 121 can realize various control functions by executing programs stored in the ROM 121*c* or the nonvolatile memory 121*d* by using the CPU 121*a*. Furthermore, the timer 121*e* measures a time.

The parameter table 121*f* may be provided in, e.g., the ROM 121*c* or the nonvolatile memory 121*d* in the ejection control unit 121. The parameter table 121*f* stores data that is used for setting timing for delivering each sheet ejected from the supply unit 11 to the conveyance path of the conveyance unit 13. For example, in the parameter table 121*f*, as data that should be set to control delivery of each sheet in accordance with a thickness of a preceding sheet (or a relative thickness difference from the preceding sheet), data representing, e.g., rotation timing, a rotation speed, or acceleration time of a delivery roller 127.

Delivery timing of each sheet represented by the data stored in the parameter table 121*f* is used to adjust a conveyance interval (GAP) between a sheet to be delivered and a sheet that has been delivered immediately before the former sheet (a preceding sheet). That is, the ejection control unit 121 controls delivery timing of each sheet ejected from the supply unit 11 based on the data set in the parameter table 121*f* and thereby adjusts the conveyance interval (GAP) between two sheets conveyed in sequence on the conveyance path of the conveyance unit 13.

A drive circuit 122 is connected to the ejection control unit 121. The drive circuit 122 is a circuit that drives a motor 123. The motor 123 drives an ejection roller 124 provided in the ejection unit 12. The ejection roller 124 is a roller configured to eject each sheet from the supply path 11. That is, the ejection control unit 121 controls the drive circuit 122 and thereby controls ejection of each sheet effected by the ejection roller 124 that is operated by the motor 123.

Moreover, a drive circuit 125 is connected to the ejection control unit 121. The drive circuit 125 is a circuit that drives a motor 126. The motor 126 drives a delivery roller 127 provided in the ejection unit 12. The delivery roller 127 is a roller configured to supply each sheet ejected by the ejection roller 124 to the conveyance path of the conveyance unit 13 in the sheet processing apparatus 1. The ejection control unit 121 controls the drive circuit 125 and thereby controls delivery of each sheet effected by the delivery roller 127 that is operated by the motor 126.

It is to be noted that the ejection roller 124 driven by the motor 123 may be configured to supply each sheet ejected from the supply unit 11 to the conveyance path of the conveyance unit 13. In this case, in the ejection unit 12, the drive circuit 125 and the motor 126 that drive the delivery roller 127 may be omitted, and the ejection control unit 121 may be configured to control timing for supplying each sheet ejected from the supply unit 11 to the conveyance path of the conveyance unit 13 by controlling driving of the ejecting roller 124.

Additionally, each sensor provided in and around the ejection unit 12 is connected to the ejection control unit 121. For example, a GAP measurement sensor (a detection sensor) 128 configured to detect a leading end and a trailing end of each ejected sheet is connected to the ejection control unit 121. Further, a thickness measurement sensor 129 configured to detect a thickness of each ejected sheet is connected to the ejection control unit 121. The thickness measurement sensor 129 measures a thickness of each sheet by using, e.g., a sensor that detects reflection of a laser beam.

The conveyance control unit 131 controls the conveyance unit 13. The conveyance unit 13 conveys each sheet supplied from the ejection unit 12 through the conveyance path in the sheet processing apparatus. The conveyance control unit 131 operates a conveyance mechanism constituting the conveyance path in the sheet processing apparatus at a constant speed and thereby carries out conveyance control for conveying each sheet to each unit.

The discharge control unit 141 controls discharge processing of each sheet effected by the discharge unit 14. The discharge control unit 141 checks whether each sheet should be discharged in accordance with a detection result of each sensor provided in the discharge unit 14. The discharge control unit 141 executes control for discharging each sheet determined to be discharged.

The determination control unit 151 determines sorting information of each sheet (e.g., a destination such as an address and a postal code). The determination control unit 151 supplies the sorting information of each sheet to the control unit 101. The determination control unit 151 acquires a barcode read result obtained by the pre-barcode read unit 15, a character recognition result as the sorting information obtained by the character recognition unit 16, or a barcode read result obtained by the verify barcode read unit 18. The determination control unit 151 determines the sorting information of each sheet based on information acquired from the pre-barcode read unit 15, the character recognition unit 16, or the verify barcode read unit 18.

The determination control unit 151 is connected to a barcode read unit (BCR) communication circuit 152, a barcode read unit (BCR) communication circuit 153, and a character recognition unit (OCR) communication circuit 154.

The BCR communication circuit 152 is connected to the pre-barcode read unit 15. The BCR communication circuit 152 supplies the sorting information based on a barcode read by the pre-barcode read unit 15 to the determination control unit 151. Additionally, the BCR communication circuit 153 is connected to the verify barcode read unit 18. The BCR communication circuit 153 supplies the sorting information based on a barcode read by the verify barcode read unit 18 to the determination control unit 151. Further, the OCR communication circuit 154 is connected to the character recognition unit 16. The OCR communication circuit 154 supplies to the determination control unit 151 a character recognition result like the sorting information obtained by OCR processing with respect to an image on the sheet read by the character recognition unit 16.

The print control unit 171 controls printing effected by the print unit 17. The print control unit 171 prints a barcode representing sorting information on the first surface of the sheet by using the print unit 17.

The sorting control unit 191 executes conveyance control over each sheet in the branch unit 19 and the accumulation unit 20. To the sorting control unit 191 are connected a motor drive mechanism, a gate drive mechanism, respective sensor groups, and others.

For example, the sorting control unit 191 controls an operation of each gate as the branch unit 19. The sorting control unit 191 determines each stacker in which each sheet should be accumulated and operates each gate as the branch unit 19 so that each sheet can be distributed to each step path in the accumulation unit 20 configured to convey each sheet to a stacker that serves as an accumulating position.

Furthermore, the sorting control unit 191 controls conveyance of each sheet in the accumulation unit 20 and driving of each gate associated with each stacker. For example, each gate associated with each stacker is provided to each step path of the accumulation unit 20. Moreover, a sensor that detects presence/absence of a sheet is provided at each position of each step path in the accumulation unit 20. As a result, the sorting control unit 191 determines a conveyance status, e.g., a position of each sheet on each step path based on a detection signal from each sensor. The sorting control unit 191 controls driving of each gate associated with each stacker that should accumulate each sheet in accordance with, e.g., a conveyance status of each sheet on each step path in the accumulation unit.

A configuration of the ejection unit 12 will now be described.

A first structural example of the ejection unit 12 will be first explained.

Figure 3:
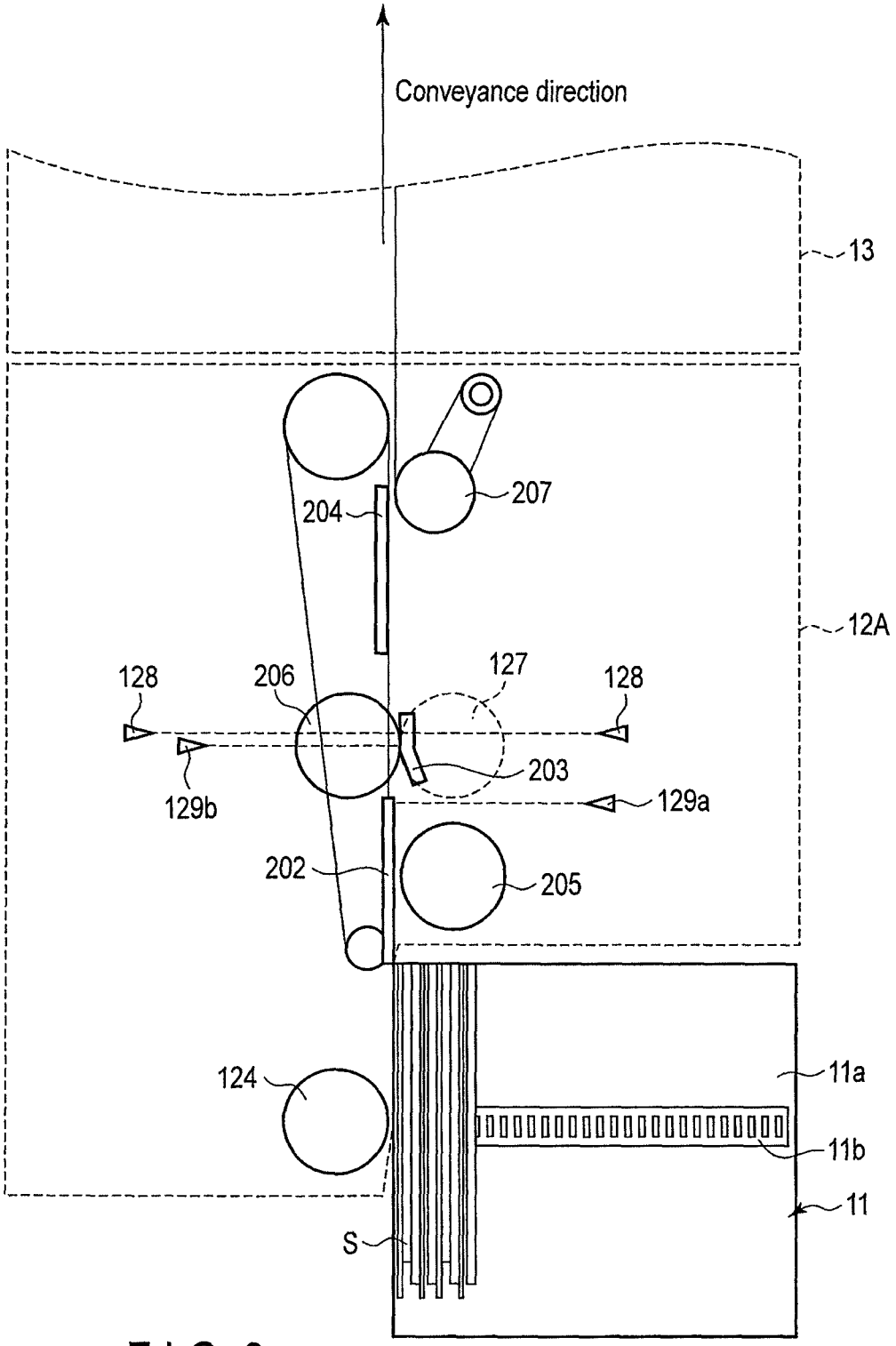
FIG. 3 is a view showing a first structural example of an ejection unit.

FIG. 3 is a view schematically showing an ejection unit 12A as the first structural example of the ejection unit 12.

The ejection unit 12A shown in FIG. 3 is a structural example of the ejection unit 12 in the sheet processing apparatus 1, and the ejection unit 12A and the ejection control unit 121 constitute the sheet ejection apparatus. Additionally, the ejection unit 12A ejects sheets one by one from the supply unit 11 having a supply base in which the sheets as processing targets are collectively set. Further, the ejection unit 12A supplies the sheets ejected from the supply unit 11 to the conveyance unit 13.

The ejection unit 12A as the first structural example of the ejection unit 12 depicted in FIG. 3 comprises the ejection roller 124, the delivery roller 127, the GAP measurement sensor (a sheet detection sensor) 128, a thickness measurement sensor 129 (129*a* or 129*b*) for measuring a thickness, guide plates 202, 203, and 204, pressure rollers 205, 206, and 207 for pressing sheets, and others.

Further, in the structural example shown in FIG. 3, the supply unit 11 comprises a supply base 11*a* on which sheets are set and an ejection feed belt 11*b* that pushes the sheets on the supply base 11*a* toward the ejection roller 124 side. In the supply unit 11, sheets (sheets as processing targets) S that are to be taken into the sheet processing apparatus 1 are aligned and stocked on the supply base 11*a*. The feed belt 11*a* is provided on the supply base 11*a*. The feed belt 11*b* pushes the sheets S stocked on the supply base 11*a* along a direction of an ejection port.

In the ejection unit 12A, the ejection roller 124 ejects the sheets set on the supply base 11*a* of the supply unit 11 one by one from the ejection port side. The ejection roller 124 conveys each sheet ejected from the supply base 11*a* along the conveyance direction. Each sheet ejected by the ejection roller 124 is pressed by the guide plate 202 through the pressure roller 205 and conveyed toward the delivery roller 127 along the guide plate 202 in this state.

The delivery roller 127 operates in response to an operating instruction issued by the control system and adjusts a gap (GAP) from a preceding sheet. For example, the delivery roller 127 rotates by the motor 126 driven based on control effected by the ejection control unit 121, controls delivery timing for each sheet, and thereby functions as a GAP compensation unit that adjusts the gap (GAP) from the preceding sheet. The delivery roller 127 is installed to face the pressure roller 206 for pressing each sheet. The pressure roller 206 is installed to be movable in accordance with a thickness of each sheet that passes between the delivery roller 127 and the pressure roller 207. As a result, the delivery roller 127 and the pressure roller 206 sandwich each sheet therebetween with appropriate force and send the sheet by using rotation of the delivery roller 127. Furthermore, the guide plate 203 that leads each sheet supplied from the ejection roller 124 side to a space between the delivery roller 127 and the pressure roller 206 is provided near the delivery roller 127.

Moreover, as a sensor configured to measure the gap (GAP) from a preceding sheet, the GAP measurement sensor (the sheet detection sensor) 128 that determines a contact position of the delivery roller 127 and the pressure roller 206 or the vicinity of this contact position as a detecting position is provided in the ejection unit 12A. The sheet detection sensor 128 as the GAP measurement sensor supplies a detection signal indicative of whether a sheet is present at the detecting position to the ejection control unit 121. For example, the conveyance control unit 121 determines that a leading end of a sheet has reached the detecting position when the GAP measurement sensor 128 detected the sheet, and it determines that a trailing end of the sheet has passed the detecting position when the detected sheet is no longer detected.

Moreover, as to each sheet ejected by the ejection roller 124, if its leading end in the conveyance direction has reached the detecting position of the GAP measurement sensor (the sheet detection sensor) 128, the gap (GAP) from a preceding sheet is adjusted by the delivery roller 127 and the pressure roller 206. For example, the ejection control unit 121 may temporarily stop the conveyance when the GAP measurement sensor 128 detected the end of the sheet ejected by the ejection roller 124 in the conveyance direction (when the end of the sheet reached the space between the delivery roller 127 and the pressure roller 206), operate the delivery roller 127 at desired timing (delivery timing according to the set GAP), and thereby control (adjust) timing for sending the sheet to the conveyance path as the conveyance unit 13 in the sheet processing apparatus 1.

Additionally, the ejection control unit 121 determines the gap (GAP) from the preceding sheet when the GAP measurement sensor 128 detects the end of the sheet. When the ejection control unit 121 has received a detection signal indicating that the end of the sheet was detected from the GAP measurement sensor 128, it determines the gap based on, e.g., an elapsed time after the trailing end of the sheet sent immediately before the counterpart (the preceding sheet) passed the GAP measurement sensor 128. For example, the gap from the preceding sheet is determined based on a time required until the leading end of the sheet reaches the GAP measurement sensor 128 after the trailing end of the preceding sheet passes the GAP measurement sensor 128 and a conveyance speed of the conveyance unit 13. Further, a position of the preceding sheet may be identified by, e.g., a sensor provided on the conveyance path of the conveyance unit 13, and then a gap between the preceding sheet and the sheet as a processing target may be determined based on the position of the preceding sheet and the detecting position of the GAP measurement sensor 128.

Furthermore, in the ejection unit 12A according to the first structural example is provided the thickness measurement sensor 129 (129*a* or 129*b*) configured to detect a thickness of each sheet before the leading end of the sheet ejected by the ejection roller 124 reaches the contact position of the delivery roller 127 and the pressure roller 206 (the detecting position of the GAP measurement sensor 128). The thickness measurement sensor (a thickness sensor) 129 is a sensor that measures a thickness of each sheet by using a reflective sensor or the like. In the structural example depicted in FIG. 3, as an installation example of the thickness measurement sensor (the thickness sensor) 129, the thickness measurement sensors 129*a* and 129*b* are shown.

For example, the thickness measurement sensor 129*a* detects a thickness of each sheet that passes above the guide plate 202 by using a reflective sensor provided at a position where it faces a surface of the guide plate 202. Since the sheet is pressed against the guide plate 202 by the pressure roller 205, the thickness measurement sensor 129*a* can detect the thickness of the sheet with the surface of the guide plate 202 determined as a reference. Further, the thickness measurement sensor 129*b* detects the thickness of the sheet that passes above the guide plate 203 by using a reflective sensor installed at a position where it faces the surface of the guide plate 203. Since the sheet is pressed against the guide plate 203 by the pressure roller 206, the thickness measurement sensor 129*b* can detect the thickness of the sheet with the surface of the guide plate 203 determined as a reference.

The ejection control unit 121 stores data representing the thickness of the sheet measured by the thickness measurement sensor 129 (thickness information) in the RAM 121*b*. When the GAP measurement sensor 128 has detected a sheet, the ejection control unit 121 determines a gap (GAP) between this sheet and a preceding sheet and reads the thickness information of the preceding sheet from the RAM 121*b*. When the gap from the preceding sheet and the thickness of the preceding sheet have been identified, the ejection control unit 121 sets the gap (GAP) associated with the thickness of the preceding sheet by making reference to the parameter table 121*f* and decides delivery timing for the sheet associated with the gap from the preceding sheet.

For example, if the preceding sheet has a larger thickness than the sheet to be supplied (if the preceding sheet is a sheet thicker than a predetermined thickness (which may be also referred to a thick matter hereinafter) or if the thickness of the preceding sheet is larger than the thickness of the sheet in question by a predetermined value or a higher value), the ejection control unit 121 sets a thick matter GAP as a gap (GAP) from the preceding sheet and supplies the sheet so that a conveyance (feed) gap from the preceding sheet can be a GAP for the thick matter.

The thick matter GAP is a GAP wider than the regular GAP, and it is a GAP that is set to prevent the sheet to be fed from catching up the preceding sheet. Setting information, e.g., the regular GAP and the thick matter GAP is stored in the parameter table 121*f* in advance, and the ejection control unit 121 sets one of the regular GAP and the thick matter GAP based on the setting information stored in the parameter table 121*f*. As a result, if delay in conveyance is expected in the sheet processing apparatus 1 due to the thickness of the preceding sheet, adjusting feed timing for the following sheet enables preventing the sheet to be supplied from catching up the preceding sheet.

Furthermore, if a difference between the thickness of the preceding sheet and the thickness of the sheet to be supplied is small (if the preceding sheet is not a thick matter or if a difference between the thickness of the preceding sheet and the thickness of the sheet to be supplied is less than a predetermined value), the ejection control unit 121 sets the regular GAP and supplies the sheet in such a manner that the gap (GAP) from the preceding sheet becomes the regular GAP.

The ejection control unit 121 controls delivery of the sheet using the delivery roller 127 as the GAP compensation unit so that the gap between the target sheet and the preceding sheet can be the set GAP (the regular GAP or the thick matter GAP). For example, the ejection control unit 121 drives and controls the delivery roller 127 that delivers the sheet based on, e.g., rotation timing, a rotation speed, or an acceleration time of the delivery roller 127 set by using the parameter table 121*f* so that the GAP between the sheet and the preceding sheet can be the set GAP.

The delivery roller 127 delivers the sheet in the conveyance direction along the guide plate 203 and the pressure roller 206 under control of the ejection control unit 121. The sheet delivered by the delivery roller 127 is supplied to the conveyance path in the main body of the sheet processing apparatus 1 as the conveyance unit 13 and conveyed at a constant conveyance speed. In this case, each sheet is supplied to the conveyance path in the main body of the sheet processing apparatus 1 so that the gap set based on the thickness of the preceding sheet and the like can be provided.

In the sheet ejection apparatus having the ejection unit 12A as the first structural example, when the thickness of the preceding sheet is not smaller than the predetermined value (a thick matter) or when a difference from the thickness of the preceding sheet is not smaller than the predetermined value, the conveyance of the sheet can be delayed, and the delivery gap (GAP) between the preceding sheet and the target sheet can be expanded. As a result, in the sheet processing apparatus to which the sheets are sequentially supplied from the sheet ejection apparatus, each following sheet to be conveyed can be prevented from catching up the preceding sheet.

Control over the ejection unit 12A (sheet ejection (delivery) processing) as the first structural example will now be described.

Figure 4:
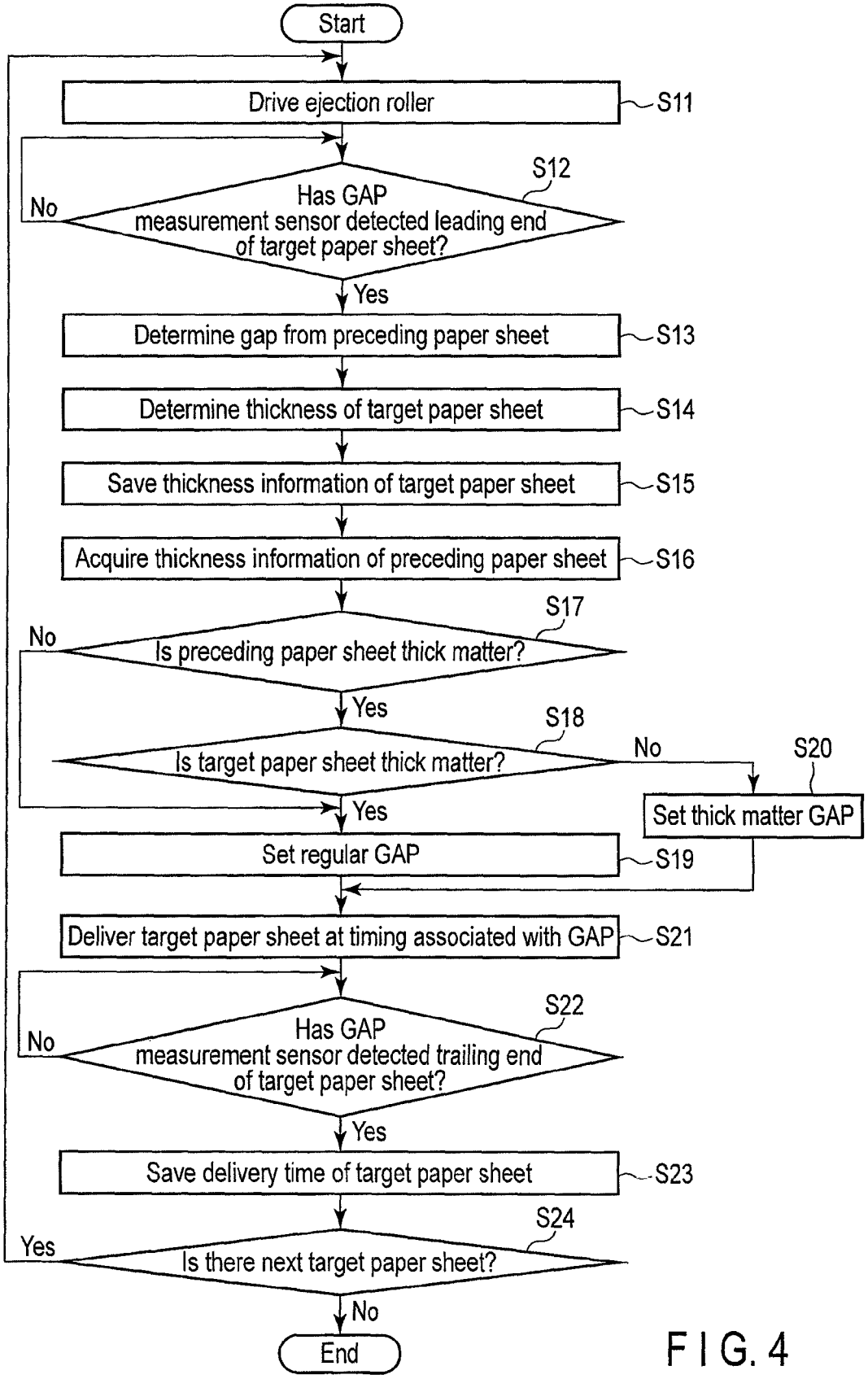
FIG. 4 is a flowchart for explaining ejection processing in the ejection unit according to the first structural example.

FIG. 4 is a flowchart for explaining a flow of sheet ejection (delivery) processing for the ejection unit 12A as the first structural example.

First, to eject out sheets as processing targets (which will be referred to as target sheets hereinafter) from the supply unit 11 one by one, the CPU 121*a* of the ejection control unit 121 drives the ejection roller 124 by using the drive circuit 122 and the motor 123 (a step S11). The ejection roller 124 driven by the motor 123 ejects one sheet from the ejection port side of the supply base 11*a* in the supply unit 11 and supplies the ejected sheet to the delivery roller 127.

After the ejection roller 124 is driven, the CPU 121*a* of the ejection control unit 121 judges whether the leading end of the target sheet has reached the detecting position of the GAP measurement sensor 128 based on a detection signal from the GAP measurement sensor 128 (a step S12). If it is determined that the target sheet has reached the detecting position of the GAP measurement sensor 128 (YES at the step S12), the CPU 121*a* of the ejection control unit 121 determines a gap (GAP) to a sheet that precedes the target sheet (which will be referred to as a preceding sheet hereinafter) (a step S13). For example, in the ejection control unit 121, a time at which the trailing end of the preceding sheet passed the detecting position of the GAP measurement sensor 128 is stored in the RAM 121*b* in advance, and the CPU 121*a* determines the gap (GAP) to the preceding sheet based on a difference between a time at which the leading end of the target sheet was detected by the GAP measurement sensor 128 and the time at which the trailing end of the preceding sheet passed the detecting position of the GAP measurement sensor 128.

Further, after the ejection roller 124 is driven, the CPU 121*a* of the ejection control unit 121 acquires a detection signal indicative of a thickness of the target sheet from the thickness measurement sensor 129 (129*a* or 129*b*). Upon acquiring the detection signal indicative of the thickness of the target sheet from the thickness measurement sensor 129, the CPU 121*a* determines the thickness of the target sheet (a step S14). When the thickness of the target sheet has been determined, the CPU 121*a* stores information representing the determined thickness of the target sheet in the RAM 121*b* (a step S15). It is to be noted that the CPU 121*a* may acquire the detection signal indicative of the thickness from the thickness measurement sensor 129 as required and determine the thickness, or it may acquire the detection signal from the thickness measurement sensor 129 and determine the thickness when the GAP measurement sensor 128 has detected the leading end of the target sheet.

Upon determining the thickness of the target sheet, the CPU 121*a* reads out thickness information representing the thickness of the preceding sheet from the RAM 121*b* (a step S16). The thickness information of the preceding sheet is obtained by measurement effected by the thickness measurement sensor 129 before the preceding sheet passes the detecting position of the GAP measurement sensor 128, and it is stored in the RAM 121*b*.

When the thickness information of the preceding sheet has been acquired, the CPU 121*a* judges whether preceding sheet is a thick matter based on the read thickness information of the preceding sheet (a step S17). For example, the CPU 121*a* judges whether the preceding sheet is a thick matter based on whether the thickness of the preceding sheet is higher than a predetermined reference value. If it is determined that the preceding sheet is a thick matter (YES at the step S17), the CPU 121*a* judges whether the target sheet is a thick matter (a step S18). For example, the CPU 121*a* judges whether the target sheet is a thick matter based on whether the thickness of the target sheet determined at the step S14 is higher than the predetermined reference value.

If it is determined that the preceding sheet is not a thick matter (NO at the step S17) and if it is determined that the preceding sheet is a thick matter and the target sheet is also a thick matter (YES at the step S18), the CPU 121*a* sets the regular GAP as a gap (GAP) from the preceding sheet (a step S19).

If it is determined that the preceding sheet is a thick matter and the target sheet is not a thick matter (NO at the step S18), the CPU 121*a* sets the thick matter GAP, which is a wider gap than the regular GAP, as the gap (GAP) from the preceding sheet (a step S20). Setting information, e.g., the thick matter GAP and the regular GAP is stored in the parameter table 121*f* in advance. If the preceding sheet is a thick matter and the target sheet is not a thick matter, the CPU 121*a* sets the thick matter GAP based on the setting information stored in the parameter table 121*f*.

When the GAP (the regular GAP or the thick matter GAP) associated with the thicknesses of the preceding sheet and the target sheet has been set, the CPU 121*a* drives the delivery roller 127 at timing according to the set GAP and delivers the target sheet (a step S21). In case of driving the delivery roller 127 and delivering the target sheet, the CPU 121*a* checks timing which the trailing end of the target sheet passes by using a detection signal from the GAP measurement sensor 128 (a step S22).

When the GAP measurement sensor 128 has detected passage of the trailing end of the target sheet (YES at the step S22), the CPU 121*a* stores information representing a time at which the target sheet passed in the RAM 121*b* (a step S23). For example, the CPU 121*a* may store the time at which the target sheet passed the detecting position of the GAP measurement sensor 128 in the RAM 121*b* in association with the information representing the thickness of the target sheet.

When the target sheet passes the detecting position (the delivery roller 127) of the GAP measurement sensor 128, the CPU 121*a* confirms whether a subsequent sheet as a processing target is preset in the supply unit 11 (a step S24). If the subsequent sheet as the processing target is present in the supply unit 11 (YES at the step S24), the CPU 121*a* returns to the step S11 and executes the processing of the steps S11 to S24 with respect to the subsequent sheet as the processing target. If the subsequent sheet as the processing target is not present in the supply unit 11 (NO at the step S24), the CPU 121*a* terminates the sheet ejection processing.

According to the above-described processing, if the preceding sheet is a thick matter and the target sheet is not a thick matter, the delivery timing for the target sheet from the ejection unit 12 can be adjusted in such a manner that the gap between the preceding sheet and the target sheet becomes the thick matter GAP. As a result, each gap between the sheets sequentially supplied from the sheet ejection apparatus in the conveyance path in the sheet processing apparatus becomes an appropriate gap, and it is possible to avoid an inconvenience that the following sheet catches up the preceding sheet.

It is to be noted that, at the steps S17 and S18, if the preceding sheet is a thick matter and the target sheet is not a thick matter (i.e., if the thickness of the preceding sheet is larger than that of the target sheet), the thick matter GAP is set, but the thick matter GAP may be set if the preceding sheet is a thick matter irrespective of the thickness of the target sheet. In this case, a judgment on whether the thick matter GAP should be set can be facilitated.

Further, in the above processing example, one of the regular GAP and the thick matter GAP is set as the gap (GAP) for the preceding sheet, GAPs in stages may be set in accordance with a difference between the thickness of the preceding sheet and the thickness of the target sheet. For example, this configuration can be realized by setting GAPs associated with differences in thickness in the parameter table 121*f* in advance and selecting each GAP associated with each difference in thickness.

A second structural example of the ejection unit 12 will now be described.

Figure 5:
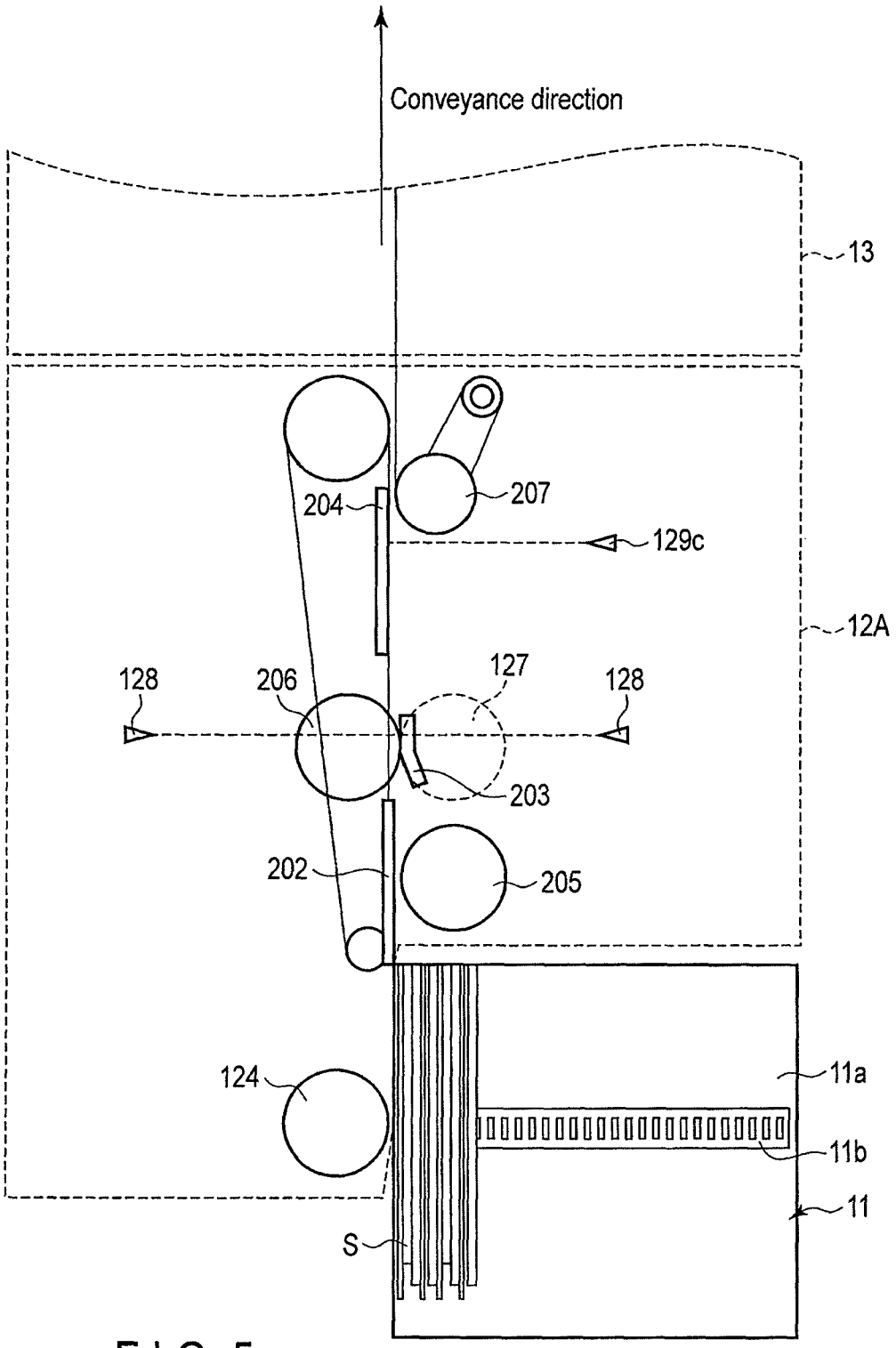
FIG. 5 is a view showing a second structural example of the ejection unit.

FIG. 5 is a view schematically showing a structural example of the ejection unit 12B as the second structural example of the ejection unit 12.

The ejection unit 12B shown in FIG. 5 is a structural example of the ejection unit 12 in the sheet processing apparatus 1, and the ejection unit 12B and an ejection control unit 121 constitute a sheet ejection apparatus. Further, the ejection unit 12B ejects sheets one by one from a supply unit 11 having a supply base 11*a* on which the sheets as processing targets are collectively set. Furthermore, the ejection unit 12B supplies each sheet ejected from the supply unit 11 to a conveyance unit 13.

As shown in FIG. 5, the ejection unit 12B as the second structural example comprises an ejection roller 124, a delivery roller 127, a GAP measurement sensor (a sheet detection sensor) 128, a thickness measurement sensor 129 (129*a* or 129*b*), guide plates 202, 203, and 204, pressure rollers 205, 206, and 207 for pressing sheets, and others.

As shown in FIG. 5, in the ejection unit 12B as the second structural example, the respective physical structures (structures, e.g., the ejection roller 124, the delivery roller 127, the GAP measurement sensor (a sheet detection sensor) 128, the guide plates 202, 203, and 204, and the pressure rollers 205, 206, and 207 for pressing sheets) other than the arrangement of a thickness measurement sensor 129*c* may be equal to the respective structures in the ejection unit 12 as the first structural example shown in FIG. 3.

In the second structural example depicted in FIG. 5, the thickness measurement sensor 129*c* is provided on the downstream side of the ejection unit 12B in a conveyance direction of the delivery roller 127. The thickness measurement sensor 129*c* supplies to the CPU 121*a* a detection signal indicative of a thickness of each sheet delivered from a contact position (a detecting position of the GAP measurement sensor 128) of the delivery roller 127 and the pressure roller 206. The thickness measurement sensor (a thickness sensor) 129*c* measures a thickness of each sheet by using, e.g., a reflective sensor. In the ejection unit 12B shown in FIG. 5, the thickness measurement sensor 129*c* detects a thickness of each sheet that passes above the guide plate 204 by using a reflective sensor installed at a position where it faces a surface of the guide plate 204. Since each sheet is pressed by the pressure roller 207 and conveyed to the guide plate 204 in this state, the thickness measurement sensor 129*c* can detect a thickness of the sheet with the surface of the guide plate 203 determined as a reference.

Moreover, the delivery roller 127 functions as a GAP compensation unit that operates in response to an operating instruction issued by a control system and thereby adjusts a gap (GAP) from a preceding sheet. The ejection control unit 121 sets a gap (GAP) associated with a thickness of the preceding sheet based on setting information in a parameter table 121*f* and drives the delivery roller 127 at delivery timing associated with the set GAP.

In the ejection unit 12B as the second structural example, a detecting position of the thickness measurement sensor 129 is arranged on the downstream side of the delivery roller 127 along the conveyance direction of sheets. Therefore, in the ejection unit 12B, a thickness of a target sheet cannot be determined when a leading end of the target sheet reached the delivery roller 127 (when the GAP measurement sensor detected the leading end of the target sheet). Therefore, as control cover the ejection unit 12B, the ejection control unit 121 sets the GAP associated with the thickness of the preceding sheet when the GAP measurement sensor 128 detected the sheet.

That is, when the GAP measurement sensor 128 detected the sheet, the ejection control unit 121 reads out the thickness of the preceding sheet from an RAM 121*b*, makes reference to the parameter table 121*f*, and sets a gap (a regular GAP or a thick matter GAP) from the preceding sheet associated with the thickness of the preceding sheet. The ejection control unit 121 drives and controls the delivery roller 127 that supplies the sheet in accordance with rotation timing, a rotation speed, or an acceleration time of the delivery roller 127 set by the parameter table 121*f* so that the GAP between the sheet and the preceding sheet can be the set GAP.

The delivery roller 127 delivers the sheet in the conveyance direction along the guide plate 203 and the pressure roller 206 under control of the ejection unit. The sheet delivered by the delivery roller 127 is supplied to the conveyance path in the main body of the sheet processing apparatus 1 as the conveyance unit 13 and conveyed at a constant conveyance speed. In this case, each sheet is supplied to the conveyance path in the main body of the sheet processing apparatus 1 so that the gap set based on the thickness of the preceding sheet and the like can be provided.

In the sheet ejection apparatus having the ejection unit 12B as the second structural example, when the thickness of the preceding sheet is not smaller than a predetermined value (a thick matter), the conveyance of the sheet can be delayed, and the delivery gap (GAP) between the preceding sheet and the target sheet can be expanded. That is, the ejection unit 12B as the second structural example can control the delivery timing of the target sheet in accordance with the thickness of the preceding sheet and, in the sheet processing apparatus 1 to which the sheets are sequentially supplied from the ejection unit 12B, each following sheet can be prevented from catching up the preceding sheet even if a conveyance speed is lowered due to the thickness of the preceding sheet.

Control over the ejection unit 12B (sheet ejection (delivery) processing) as the second structural example will now be described.

Figure 6:
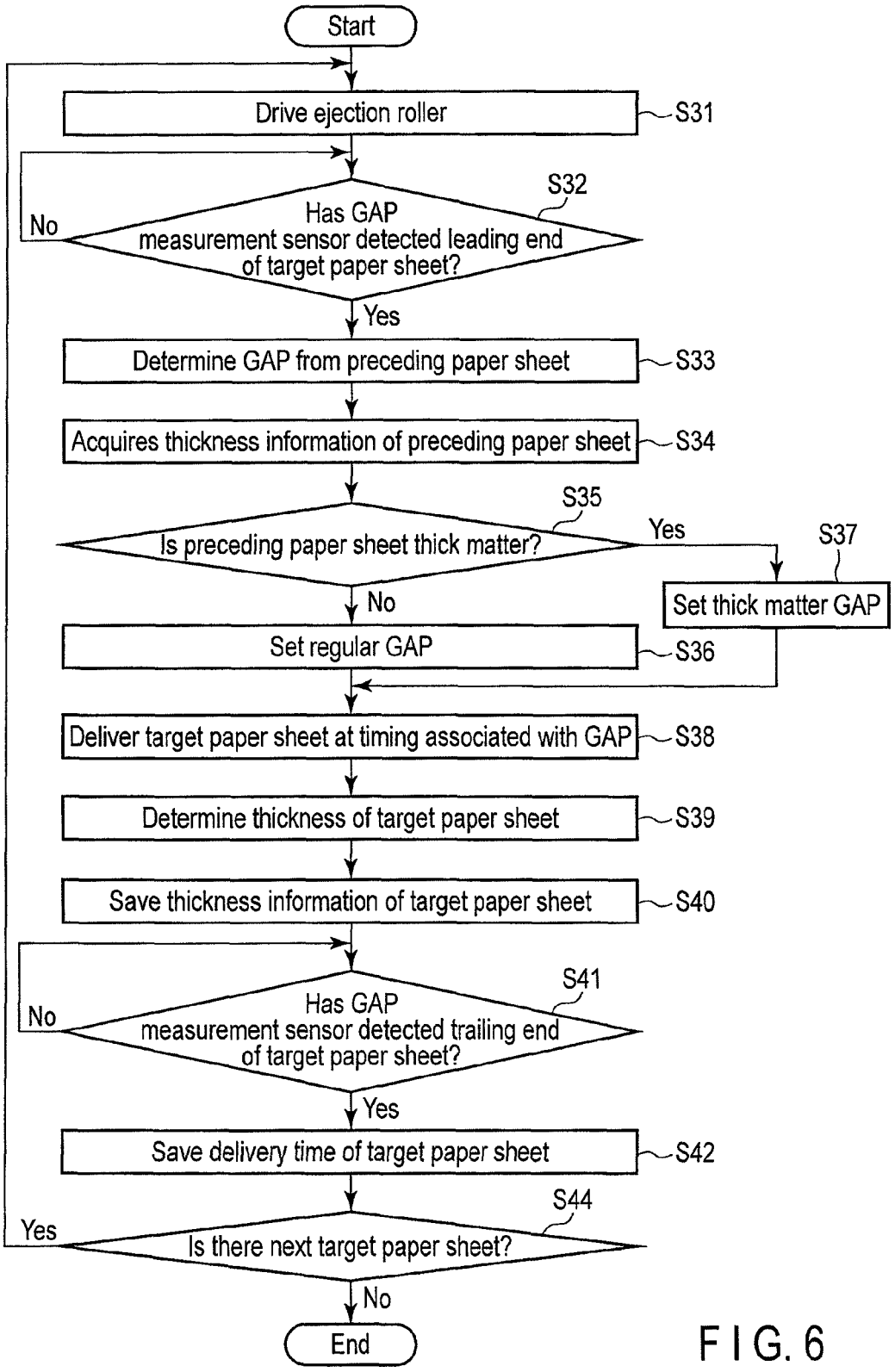
FIG. 6 is a flowchart for explaining ejection processing in the ejection unit according to the second structural example.

FIG. 6 is a flowchart for explaining a flow of sheet ejection (delivery) processing with respect to the ejection unit 12B as the second structural example.

First, the CPU 121*a* of the ejection control unit 121 drives the ejection roller 124 (a step S31), ejects one sheet from the supply unit 11, and supplies the ejected sheet to the delivery roller 127. After the ejection roller 124 is driven, the CPU 121*a* of the ejection control unit 121 judges whether a leading end of the sheet (which will be referred to as a target sheet hereinafter) ejected by the ejection roller 124 has reached the detecting position of the GAP measurement sensor 128 based on a detection signal from the GAP measurement sensor 128 (a step S32).

If it is determined that the target sheet has reached the detecting position of the GAP measurement sensor 128 (YES at the step S32), the CPU 121*a* of the ejection control unit 121 determines a GAP between the target sheet and a sheet that precedes the former (which will be referred to as a preceding sheet hereinafter) (a step S33). For example, the CPU 121*a* determines a gap (GAP) of the preceding sheet based on an elapsed time from a time at which a trailing end of the preceding sheet passed the detecting position of the GAP measurement sensor 128.

Further, after the ejection roller 124 is driven, the CPU 121*a* of the ejection control unit 121 reads out information representing a thickness of the preceding sheet from the RAM 121*b* (a step S34). It is assumed that the thickness information of the preceding sheet was saved in the RAM 121*b* when the ejection processing for the preceding sheet was carried out. Upon acquiring the thickness information of the preceding sheet, the CPU 121*a* judges whether the preceding sheet is a thick matter based on the read thickness information of the preceding sheet (a step S35). For example, the CPU 121*a* judges whether the preceding sheet is a thick matter based on whether the thickness of the preceding sheet is larger than a predetermined reference value.

When it is determined that the preceding sheet is not a thick matter (NO at the step S35), the CPU 121*a* sets the regular GAP as the gap (GAP) from the preceding sheet (a step S36). Further, when it is determined that the preceding sheet is a thick matter (YES at the step S35), the CPU 121*a* set the thick matter GAP, which is a wider gap than the regular GAP, as the gap (GAP) from the preceding sheet (a step S37). Data indicative of the thick matter GAP is stored in, e.g., the parameter table 121*f*, and the CPU 121*a* makes reference to the parameter table 121*f* and sets the thick matter GAP.

When the GAP (the regular GAP or the thick matter GAP) associated with the thickness of the preceding sheet has been set, the CPU 121*a* drives the delivery roller 127 at timing associated with the set GAP and delivers the target sheet (a step S38). After the delivery roller 127 was driven and the target sheet was delivered, the CPU 121*a* of the ejection control unit 121 acquires a detection signal indicative of a thickness of the target sheet from the thickness measurement sensor 129*c*.

Upon acquiring the detection signal indicative of the thickness of the target sheet from the thickness measurement sensor 129*c*, the CPU 121*a* determines the thickness of the target sheet (a step S39). When the thickness of the target sheet has been determined, the CPU 121*a* stores thickness information representing the determined thickness of the target sheet in the RAM 121*b* (a step S40). It is to be noted that the CPU 121*a* may acquire the detection signal indicative of the thickness from the thickness measurement sensor 129*c* as required and determine the thickness, or it may acquire the detection signal from the thickness measurement sensor 129*c* and determine the thickness when the GAP measurement sensor 128 has detected a trailing end of the target sheet.

Furthermore, after the delivery roller 127 was driven and the target sheet was delivered, the CPU 121*a* of the ejection control unit 121 checks timing at which the trailing end of the target sheet passes through the delivery roller 127 by using the detection signal from the GAP measurement sensor 128 (a step S41). When the GAP measurement sensor 128 has detected that the trailing end of the target sheet passed (YES at the step S41), the CPU 121*a* stores information representing a time at which the target sheet passed in the RAM 121*b* (a step S42). For example, the CPU 121*a* may store in the RAM 121*b* the time at which the sheet passed the detecting position of the GAP measurement sensor 128 in association with the information representing the thickness of the target sheet.

When the target sheet passed the detecting position (the delivery roller 127) of the GAP measurement sensor 128, the CPU 121*a* confirms whether a subsequent sheet as a processing target is present in the supply unit 11 (a step S43). If the subsequent sheet as the processing target is present in the supply unit 11 (YES at the step S43), the CPU 121*a* returns to the step S31 and executes the processing of the steps S31 to S43 with respect to the subsequent sheet as the processing target. If the subsequent sheet as the processing target is not present in the supply unit 11 (NO at the step S43), the CPU 121*a* terminates the sheet ejection processing.

According to the ejection processing for the ejection unit 12B as the second structural example, if the preceding sheet is a thick matter, the sheet ejection apparatus adjusts the timing for delivering the target sheet from the ejection unit 12 so that the gap from the preceding sheet can be the thick matter GAP. As a result, the ejection unit 12B as the second example can control the timing for delivering the sheet in accordance with the thickness of the preceding sheet, a gap between the respective sheets on the conveyance path becomes an appropriate gap in the main body of the sheet processing apparatus to which the sheets are sequentially supplied from the ejection unit 12B, and an inconvenience that a following sheet catches up a preceding sheet can be avoided.

It is to be noted that one of the regular GAP and the thick matter GAP is set as the gap (GAP) from the preceding sheet in the above processing example, but GAPs in stages may be set in accordance with the thickness of the preceding sheet. For example, this configuration can be realized by setting GAPs associated with thicknesses of the preceding sheets in the parameter table 121*f* in advance, setting each GAP to be selected which is associated with each thickness of the preceding sheet, and adjusting the timing for delivering the target sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A postal matter ejection apparatus comprising:

a character recognition unit configured to recognize characters on the postal matters;

an ejection unit which ejects the postal matters one-by-one from a supply base on which the postal matters are set and supplies each postal matter from the supply base to a conveyance unit;

a detection unit which detects the postal matter ejected by the ejection unit;

a reflective sensor which detects a thickness of the postal matter detected by the detection unit;

a thickness storage unit which stores thickness information detected by the reflective sensor;

an acquisition unit which acquires from the thickness storage unit a thickness of a preceding postal matter delivered to the conveyance unit immediately before the postal matter ejected by the ejection unit;

a setting unit which, for each postal matter of a plurality of postal matters in sequence ejected by the ejection unit, sets a gap between the preceding postal matter and the postal matter ejected by the ejection unit in accordance with the thickness of the preceding postal matter acquired by the acquisition unit; and an adjustment unit which adjusts timing for delivering the postal matter detected by the detection unit to the conveyance unit in accordance with the gap set by the setting unit in accordance with the measured thickness of the preceding postal matter acquired by the acquisition unit, wherein the reflective sensor detects a thickness of the postal matter before the postal matter is delivered at the timing adjusted by the adjustment unit.

2. The apparatus according to claim 1, further comprising a setting storage unit which stores setting information indicating that the gap between the preceding postal matter and a following postal matter becomes wider as the thickness of the preceding postal matter increases, wherein the setting unit sets the gap associated with the thickness of the preceding postal matter based on the setting information stored in the setting storage unit.

3. The apparatus according to claim 1, wherein the setting unit sets the gap between the preceding postal matter and the postal matter in accordance with a difference between the thickness of the preceding postal matter acquired by the acquisition unit and the thickness of the postal matter detected by the thickness detection unit.

4. The apparatus according to claim 1, further comprising a setting storage unit which stores setting information indicating that the gap between the preceding postal matter and a following postal matter becomes wider as the thickness of the preceding postal matter increases, wherein the setting unit sets the gap associated with the difference between the thickness of the preceding postal matter and the thickness of the postal matter based on the setting information stored in the setting storage unit.

5. A postal matter processing apparatus which sequentially processes postal matters, comprising:

a character recognition unit configured to recognize characters on the postal matters;

a supply unit in which the postal matters as processing targets are set;

an ejection unit which ejects the postal matters one-by-one from the supply unit on which the postal matters are set and supplies each postal matter from the supply unit to a conveyance unit;

a detection unit which detects the postal matter ejected by the ejection unit;

a reflective sensor which detects a thickness of each postal matter detected by the detection unit;

a thickness storage unit which stores thickness information detected by the reflective sensor;

an acquisition unit which acquires from the thickness storage unit thickness information of a preceding postal matter ejected immediately before the postal matter ejected by the ejection unit;

a setting unit which, for each postal matter of a plurality of postal matters in sequence ejected by the ejection unit, sets a gap between the preceding postal matter and the postal matter ejected by the ejection unit in accordance with the measured thickness of the preceding postal matter acquired from the acquisition unit;

an adjustment unit which adjusts timing for delivering the sheet having the leading end detected by the sheet detection unit in accordance with the gap set by the setting unit in accordance with the measured thickness of the preceding postal matter delivered to the conveyance unit immediately before the postal matter detected by the detection unit;

a conveyance unit which conveys the postal matter delivered at the timing adjusted by the adjustment unit; and a processing unit which sequentially processes the postal matter conveyed along the conveyance unit, wherein the reflective sensor detects a thickness of the postal matter before the postal matter is delivered at the timing adjusted by the adjustment unit.

* * * * *